US009667000B1

(12) United States Patent
Morello et al.

(10) Patent No.: US 9,667,000 B1
(45) Date of Patent: May 30, 2017

(54) RADIO FREQUENCY COAXIAL CONNECTOR ASSEMBLY AND METHOD OF MANUFACTURING SAME

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc.

( * ) Notice: Subject to any disclaimer, the term of this patent is extended or adjusted under 35 U.S.C. 154(b) by 0 days.

(21) Appl. No.: 15/177,910

(22) Filed: Jun. 9, 2016

(51) Int. Cl.

| | |
|---|---|
| ***H01R 9/05*** | (2006.01) |
| ***H01R 24/38*** | (2011.01) |
| ***H01R 43/048*** | (2006.01) |
| *H01R 103/00* | (2006.01) |

(52) U.S. Cl.
CPC ..... *H01R 24/38* (2013.01); *H01R 9/0518* (2013.01); *H01R 43/048* (2013.01); *H01R 2103/00* (2013.01)

(58) Field of Classification Search
CPC .. H01R 9/0518; H01R 2103/00; H01R 24/40; H01R 9/05; H01R 43/048; H01R 43/058; Y10T 29/53213; Y10T 29/49183; Y10T 29/53243; Y10T 29/49123
USPC ..... 439/585, 578, 877, 882, 884–887; 29/861
See application file for complete search history.

(56) References Cited

U.S. PATENT DOCUMENTS

| | | | | |
|---|---|---|---|---|
| 4,550,972 | A * | 11/1985 | Romak | H01R 13/111 439/839 |
| 6,656,002 | B2 * | 12/2003 | Zhao | H01R 13/187 439/787 |
| 7,805,838 | B2 * | 10/2010 | Morana | H01R 13/187 29/868 |
| 8,043,131 | B2 * | 10/2011 | Ngo | H01R 4/183 439/877 |
| 8,202,130 | B2 * | 6/2012 | Friese | H01R 13/5045 29/858 |
| 8,366,483 | B2 | 2/2013 | Hardy et al. | |

* cited by examiner

*Primary Examiner* — Xuong Chung Trans
(74) *Attorney, Agent, or Firm* — Robert J. Myers

(57) ABSTRACT

A coaxial connector assembly includes an inner contact terminating a center conductor of a coaxial cable, an insulator holding the inner contact, and an outer contact, which surrounds the insulator and the inner contact, terminating a shield braid of the cable. The outer contact is formed into a barrel shape and includes a seam extending along an entire length of the outer contact. The coaxial connector assembly further includes an outer ferrule and a seamless inner ferrule. The seamless inner ferrule has a first ferrule portion with a first diameter and a second ferrule portion with a second diameter that is different from the first diameter. The first ferrule portion surrounds at least a portion of the outer contact. The shield braid is sandwiched between the second ferrule portion and the outer ferrule. A method of manufacturing the coaxial connector assembly is also provided.

20 Claims, 14 Drawing Sheets

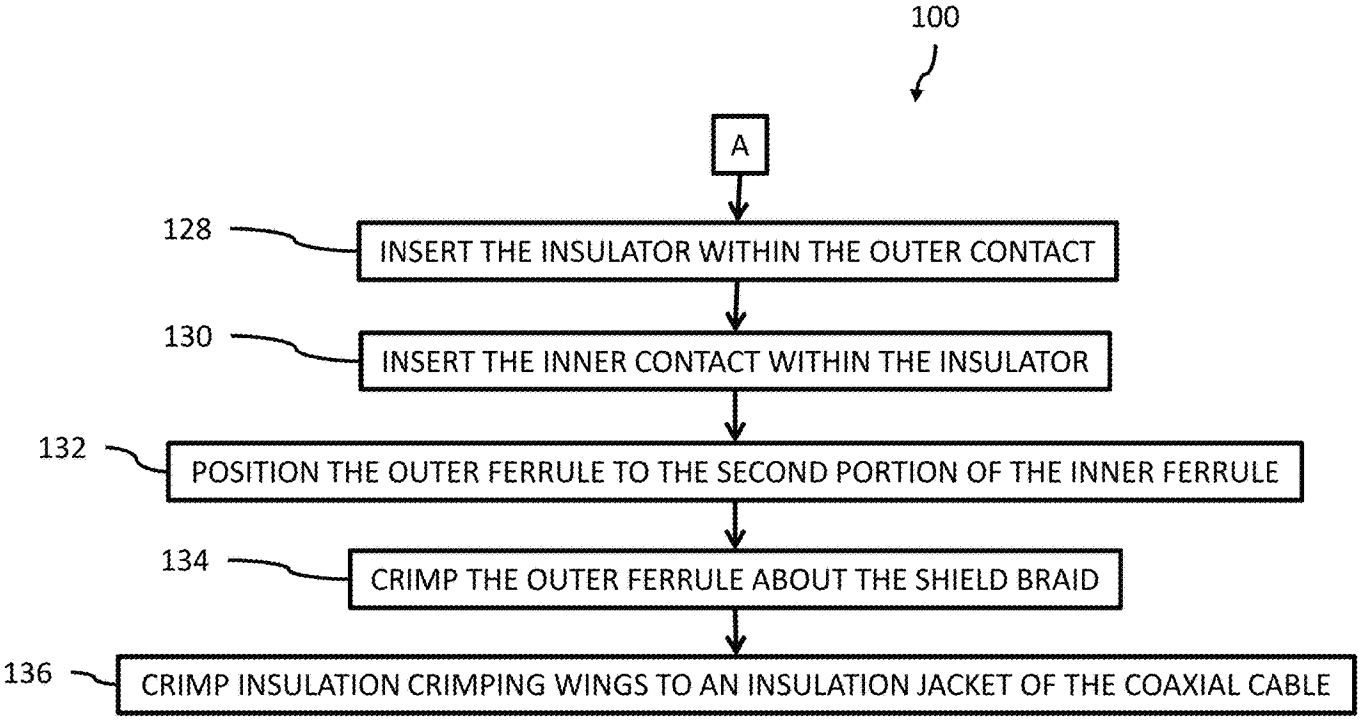
Fig. 2 con't

RADIO FREQUENCY COAXIAL CONNECTOR ASSEMBLY AND METHOD OF MANUFACTURING SAME

TECHNICAL FIELD OF THE INVENTION

The present invention relates generally to electrical connectors and, more particularly, to a coaxial connector assembly configured to conduct radio frequencies.

BACKGROUND OF THE INVENTION

Radio frequency (RF) coaxial cable connector assemblies have been used for numerous automotive applications, such as global positioning systems (GPS), infotainment systems, and air bag systems. Coaxial cables typically consist of an outer shield conductor, an inner center conductor, a dielectric, and an insulation jacket. The outer conductor and the inner conductor of the coaxial cable often electrically interface with a mating coaxial cable through socket and plug connectors. Such conventional coaxial cable connectors are known in the art.

In order to standardize various types of connectors and thereby avoid confusion, certain industry standards have been established. One of these standards is referred to as FAKRA. FAKRA is the Automotive Standards Committee in the German Institute for Standardization (in German "Deutsches Institut für Normung", best known by the acronym DIN), representing international standardization interests in the automotive field. The FAKRA standard provides a system, based on keying and color coding, for proper connector attachment. Like socket keys can only be connected to like plug keyways in FAKRA connectors. Secure positioning and locking of connector housings is facilitated by way of a FAKRA defined catch on the socket housing and a cooperating latch on the plug housing.

The connector assemblies include an inner contact and an outer contact that provides shielding for the inner contact. The outer contact is typically manufactured from a zinc die-cast or screw machined part, which is expensive to manufacture.

A need remains for a connector assembly that may be manufactured in a cost effective and reliable manner. Additionally, a need remains for a connector assembly that may utilize less expensive parts, such as stamped and formed parts, in existing outer housings and locks made for die-cast parts.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a coaxial connector assembly is provided. The coaxial connector assembly includes an inner contact configured to terminate a center conductor of a coaxial cable, an insulator formed of a dielectric material holding the inner contact, and an outer contact surrounding the insulator and the inner contact configured to terminate a shield braid of the coaxial cable. The outer contact is formed from a first flat work piece having a first contact end and a second contact end. The outer contact is formed into a barrel shape such that the first contact end opposes the second contact end at a seam extending along an entire length of the outer contact. The coaxial connector assembly further includes an outer ferrule formed from a second flat work piece and an inner ferrule seamlessly formed from a third flat work piece. The inner ferrule has a first ferrule portion with a first diameter and a second ferrule portion with a second diameter that is less than the first diameter. The first ferrule portion surrounds at least a portion of the outer contact. The shield braid is sandwiched between the second ferrule portion and the outer ferrule.

The second flat work piece may formed of sheet metal. The outer ferrule may be seamlessly formed using a deep draw stamping process. Alternatively, the outer ferrule may have a first ferrule end and a second ferrule end and wherein the outer ferrule is crimped about the shield braid such that the first ferrule end opposes the second ferrule end. The outer ferrule may include a pair of insulation crimping wings crimped to an insulation jacket of the coaxial cable.

At least a portion of the outer contact may be received within the first ferrule portion. A dimple may be formed in both the first ferrule portion and the outer contact, thereby securing the inner ferrule to the outer contact. The insulator may define a circumferential groove and at least a portion of the dimple formed in the outer contact is disposed within the circumferential groove, thereby securing the insulator within the outer contact.

The outer contact may define a first circumferential rib and the first ferrule portion defines a second circumferential rib. The inner ferrule may define a circumferential flange configured to abut the first circumferential rib.

In accordance with another embodiment of the invention, a method of forming a coaxial connector assembly is provided. The method includes the steps of forming a first flat work piece having a first contact end and a second contact end into an outer contact having a barrel shape such that the first contact end opposes the second contact end at a seam extending along an entire length of the outer contact and providing an insulator formed of a dielectric material and an inner contact configured to terminate a center conductor of a cable. The method also includes the steps of inserting the insulator within the outer contact, inserting the inner contact within the insulator, forming an outer ferrule from a second flat work piece, and seamlessly forming an inner ferrule from a third flat work piece. The inner ferrule has a first ferrule portion with a first diameter and a second ferrule portion with a second diameter that is different from the first diameter. The method further includes the steps of inserting at least a portion of the outer contact within the first ferrule portion and positioning the outer ferrule to the second ferrule portion such that a shield braid of the coaxial cable is sandwiched between the second ferrule portion and the outer ferrule.

The third flat work piece may be formed of sheet metal and the inner ferrule may be seamlessly formed using a deep draw stamping process. The second flat work piece may be formed of sheet metal and the outer ferrule may be seamlessly formed using a deep draw stamping process. Alternatively, the outer ferrule may have a first crimping wing having a first ferrule end and a second crimping wing having a second ferrule end. The method may further include the step of crimping the outer ferrule about the shield braid such that the first ferrule end opposes the second ferrule end. The outer ferrule may also have a pair of insulation crimping wings and the method may further include the step of crimping the insulation crimping wings to an insulation jacket of the coaxial cable.

The method may additionally include the step of forming a dimple in both the first ferrule portion and the outer contact, thereby securing the inner ferrule to the outer contact. The insulator may define a circumferential groove and at least a portion of the dimple formed in the outer contact may be disposed within the circumferential groove, thereby securing the insulator within the outer contact.

The method may also include the steps of forming a first circumferential rib on the outer contact, forming a second circumferential rib on the first ferrule portion, and forming a circumferential flange on the inner ferrule configured to abut the first circumferential rib.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a description of method for forming a coaxial connector assembly configured to terminate a shielded coaxial cable and suitable for use in radio frequency applications and the coaxial connector assembly formed by this method, hereinafter referred to as the coaxial connector.

Figure 1:
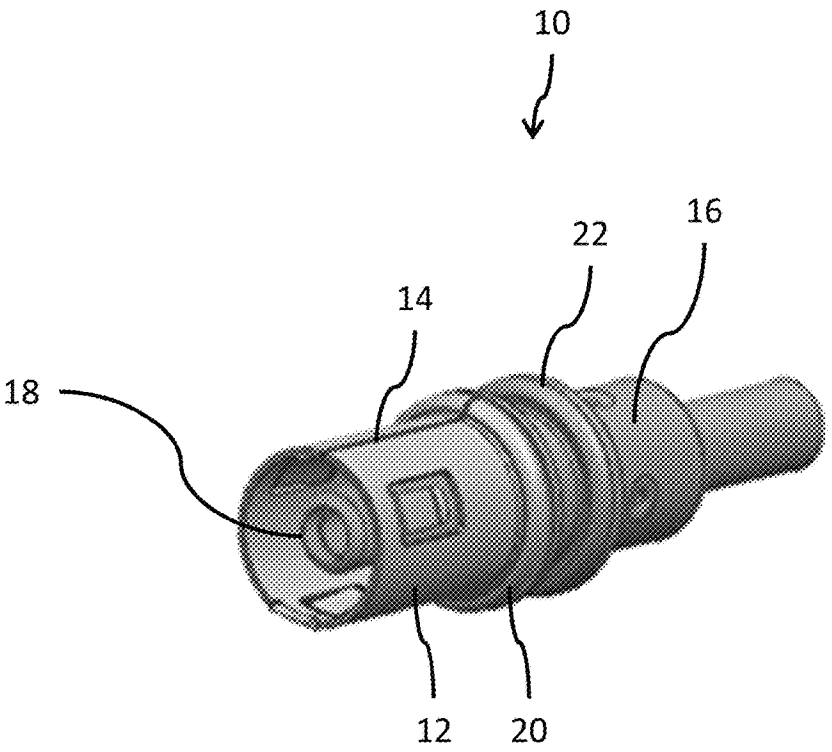
FIG. 1 is a perspective view of a coaxial connector assembly according to one embodiment.
Figure 2:
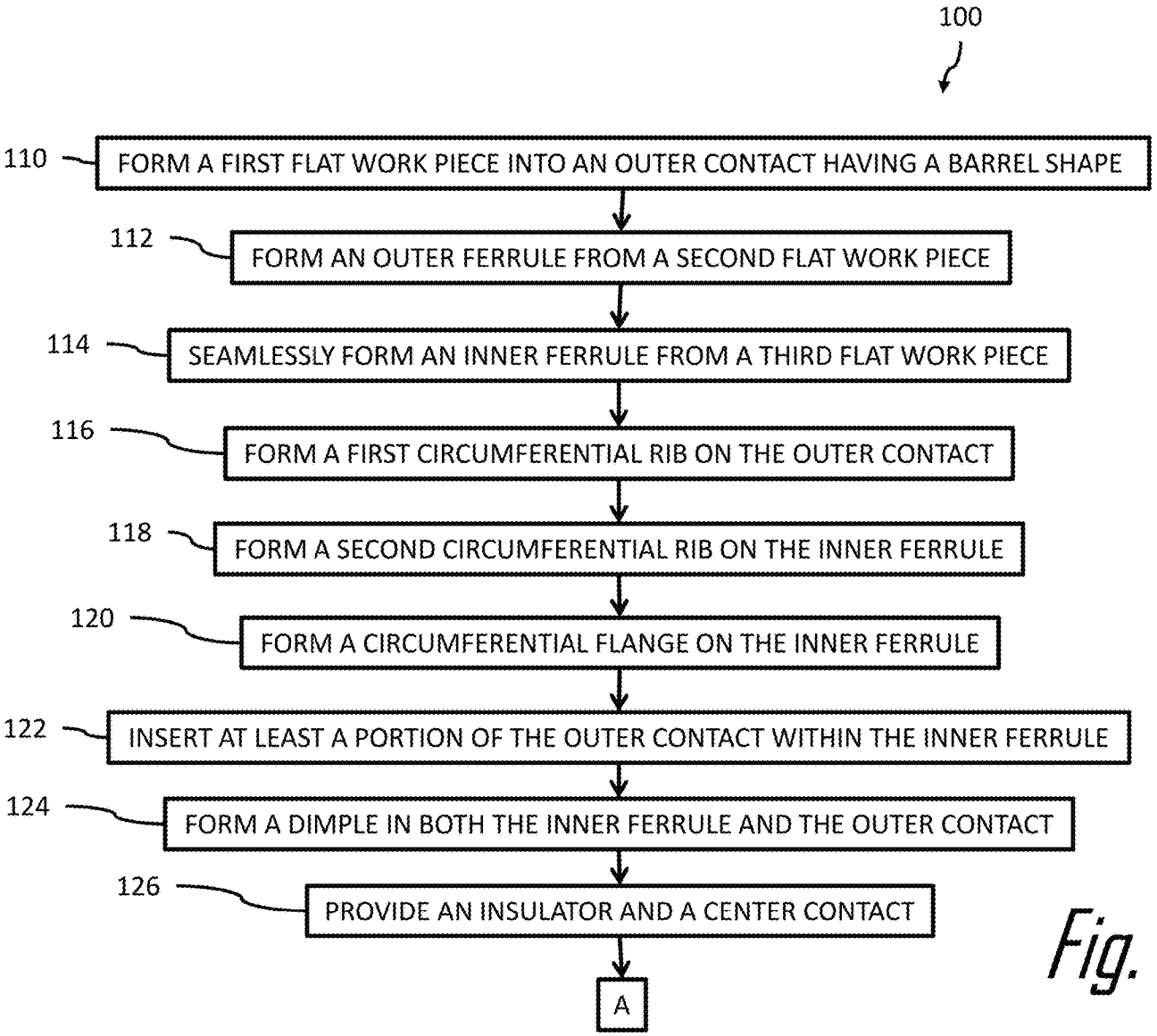
FIG. 2 is a flow chart of a method of forming the coaxial connector assembly of FIG. 1 according to one embodiment.

FIG. 1 illustrates a non-limiting example of a coaxial connector 10. The coaxial connector 10 includes an outer contact 12 that is formed into a barrel shape from a flat sheet of electrically conductive material (not shown). The outer contact 12 has a seam 14 extending longitudinally along the length of the outer contact 12. The outer contact 12 is configured to provide a shielding contact with a corresponding mating connector (not shown). The coaxial connector 10 also includes an inner ferrule 16 that is seamlessly formed from a flat sheet of electrically conductive material (not shown). The inner ferrule 16 surrounds at least a portion of the outer contact 12 and is configured to provide contact with a shielding braid of the coaxial cable. The coaxial connector 10 also includes an inner contact (not shown) contained within an insulator 18 inside the outer contact 12. The inner contact is configured to terminate a center conductor of the coaxial cable (not shown) and provide contact with a center terminal of the corresponding mating connector. This coaxial connector 10 may be used with an assembly conforming with the FAKRA standard. The outer contact 12 and the inner ferrule 16 define raised ridges 20, 22 that may cooperate with locking features within a FAKRA standard housing (not shown) to secure the coaxial connector 10 within the housing.

FAKRA connectors are radio frequency (RF) connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap on coupling and are designed to operate at either 50 Ohm or 75 Ohm impedances. The coaxial connector 10 may utilize other types of connectors other than the FAKRA connectors described herein.

FIGS. 2-13 illustrate a non-limiting example of a method 100 for forming the coaxial connector 10 shown in FIG. 1 and provide more details of the coaxial connector design. The steps of the method 100 are not necessarily performed in the order in which they are presented herein.

Figure 3:
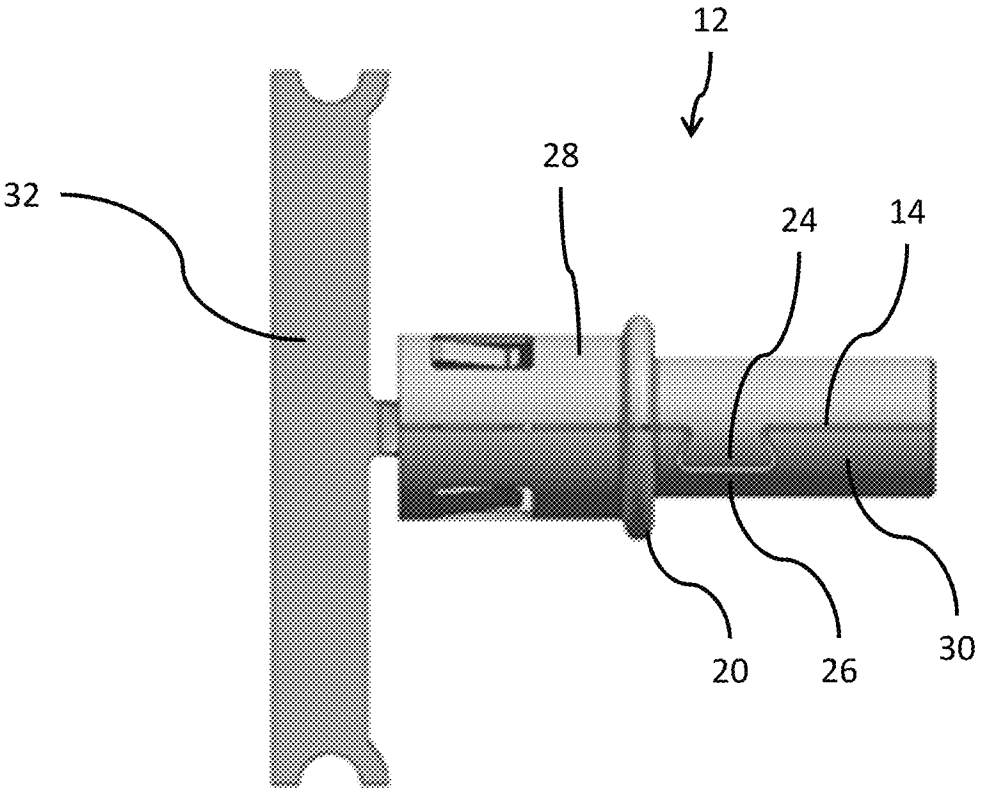
FIG. 3 is a top view of an outer contact of the coaxial connector assembly of FIG. 1 according to one embodiment.

STEP 110, FORM A FIRST FLAT WORK PIECE INTO AN OUTER CONTACT HAVING A BARREL SHAPE, includes forming a first flat work piece (not shown) having a first contact end 24 and a second contact end 26 into an outer contact 12 having a barrel or tube shape such that the first contact end 24 opposes the second contact end 26 at a seam 14 extending along an entire length of the outer contact 12 as illustrated in FIG. 3. The outer contact 12 is configured to provide electromagnetic shielding for the inner contact from electromagnetic interference (EMI) or radio frequency interference (RFI).

A first contact portion 28 is configured to receive the corresponding shield contact of the mating connector. This first contact portion 28 defines a plurality of contact arms configured to exert a spring force against the corresponding shield contact of the mating connector thereby improving the quality of the electrical connection between them. A second contact portion 30 is configured to be received within the inner ferrule 16. As can be seen in FIG. 3, the second contact portion 30 has a smaller diameter than the first contact portion 28.

The outer contact 12 may be cut from a flat strip of sheet metal by a stamping process and formed using secondary sheet metal forming processes such as rolling and embossing which makes the outer contact 12 less expensive than manufacturing the outer contact 12 by other methods, such as die-casting or screw machining. The outer contact 12, as formed, is attached to a carrier strip 32 to streamline handling of the outer contact 12 and sub-assemblies of the coaxial connector 10 as they may be automatically fed into automated assembly equipment (not shown) during the manufacturing process.

Figure 11:
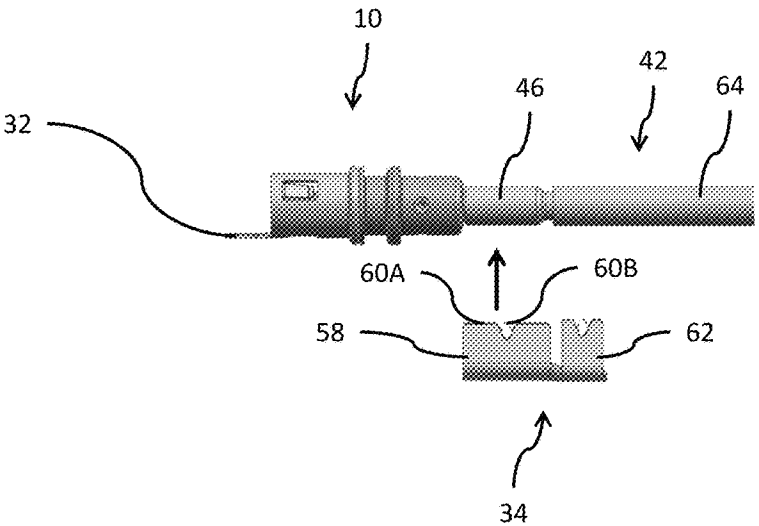
FIG. 11 is a side view of a process of attaching an outer ferrule to the assembly of FIG. 10 according to one embodiment.

STEP 112, FORM AN OUTER FERRULE FROM A SECOND FLAT WORK PIECE, includes forming an outer ferrule 34 from a second flat work piece (not shown). The outer ferrule 34 may be cut from a flat strip of sheet metal by a stamping process and formed into an open barrel shape having an open side, such as a U-shape as shown in FIG. 11, using known sheet metal forming processes. The outer ferrule 34 may be formed from the same strip of sheet metal used to form the outer contact 12 and may also be attached to the same carrier strip 32 in an alternating order with the outer contact 12 until it is separated from the carrier strip 32 in subsequent steps of the method 100. Alternatively, the outer ferrule 34 may be formed from a separate strip of sheet metal. In alternative embodiments of the coaxial connector, the outer ferrule may be formed from a seamless tube or by deep draw forming of a strip of sheet metal.

Figure 4:
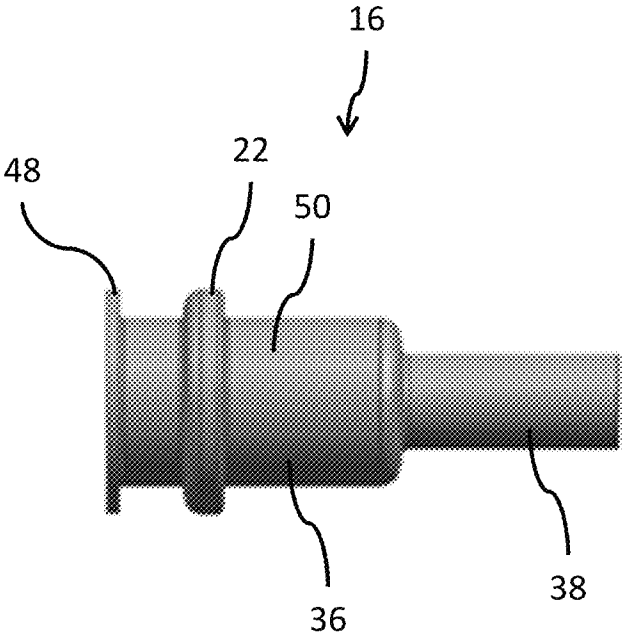
FIG. 4 is a top view of an inner ferrule of the coaxial connector assembly of FIG. 1 according to one embodiment.
Figure 5:
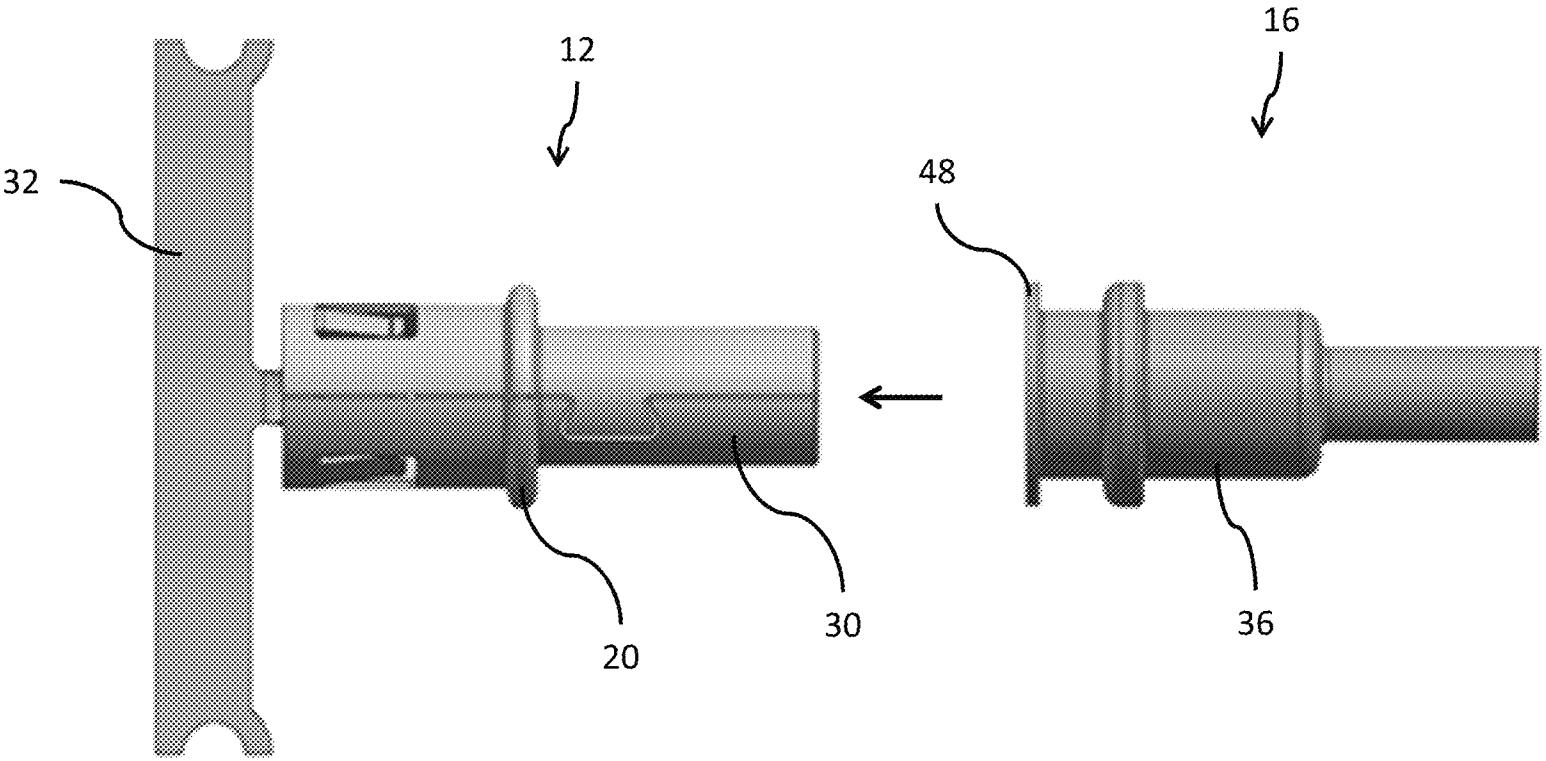
FIG. 5 is a top view of a process of inserting the outer contact of FIG. 3 in-to the inner ferrule of FIG. 4 according to one embodiment.

STEP 114, SEAMLESSLY FORM AN INNER FERRULE FROM A THIRD FLAT WORK PIECE, includes seamlessly forming an inner ferrule 16 from a third flat work piece (not shown). As illustrated in FIG. 4, the seamless inner ferrule 16 has a first ferrule portion 36 with a first diameter $D_1$ and a second ferrule portion 38 with a second diameter $D_2$ that is different from the first diameter. The diameter $D_2$ may be smaller or larger than diameter $D_1$ depending on the outer diameter of the coaxial cable 42. The first ferrule portion 36 is configured to receive and surround the second contact portion 30 of the outer contact 12. As illustrated in FIG. 5, the inner ferrule 16 is configured to receive the insulated center conductor 40 of the coaxial cable 42 within second ferrule portion 38 and an outer surface of the second ferrule portion 38 is configured to be surrounded by a shield braid 46 of the coaxial cable. The inner ferrule 16 may be formed by extruding a seamless tube or by deep draw forming of a strip of sheet metal.

STEP 116, FORM A FIRST CIRCUMFERENTIAL RIB ON THE outer contact 12, is an optional step that includes forming a first circumferential rib 20 protruding from the outer contact 12 intermediate the first contact portion 28 and the second contact portion 30 as shown in FIG. 3. The first rib 20 may be formed by an embossing process prior to forming the first work piece into a barrel shape. STEP 116 may be performed at the same time as STEP 110.

STEP 118, FORM A SECOND CIRCUMFERENTIAL RIB ON THE inner ferrule 16, is an optional step that includes forming a second circumferential rib 22 protruding from the first ferrule portion 36 as shown in FIG. 4. The first and second ribs 20, 22 may be configured to engage surfaces in the housing to hold the axial position of the coaxial connector 10 relative to the housing.

Figure 6:
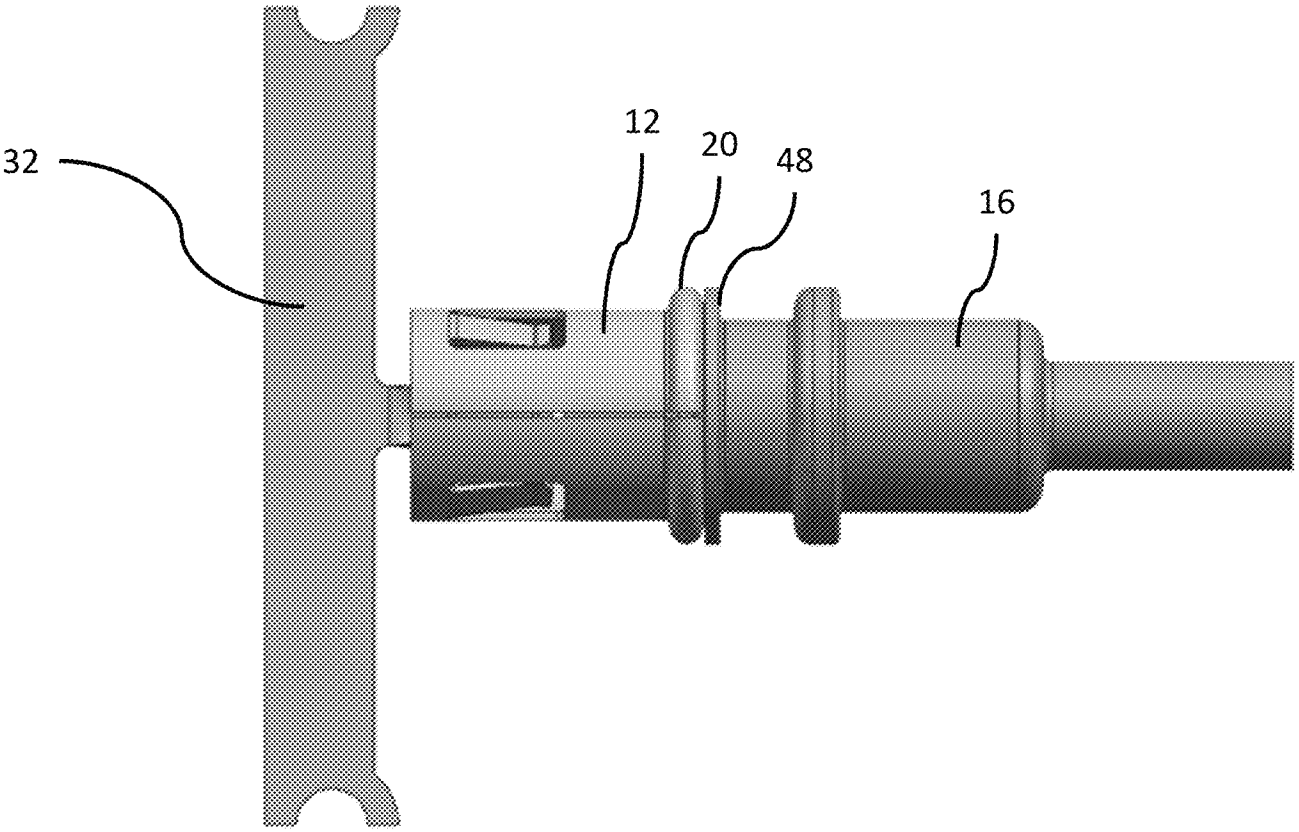
FIG. 6 is a top view of the outer contact of FIG. 3 and the inner ferrule of FIG. 4 in an assembled condition according to one embodiment.

STEP 120, FORM A CIRCUMFERENTIAL FLANGE ON THE INNER FERRULE, is an optional step that includes forming a circumferential flange 48 on a distal end of the inner ferrule 16 as shown in FIG. 4. As illustrated in FIG. 6, the flange 48 is configured to abut the first rib 20 when the second contact portion 30 is inserted within the first ferrule portion 36. The second rib 22 and the flange 48 may be formed by a swaging or upsetting process to form a surface on the second rib 22 and the flange 48 that is substantially perpendicular to the outer surface 50 of the first ferrule portion 36. As used herein, substantially perpendicular means±15° of absolutely perpendicular.

STEP 122, INSERT AT LEAST A PORTION OF THE OUTER CONTACT WITHIN THE INNER FERRULE, includes inserting at least a portion of the outer contact 12 within the first ferrule portion 36 of the inner ferrule 16 as illustrated in FIG. 6.

Figure 7:
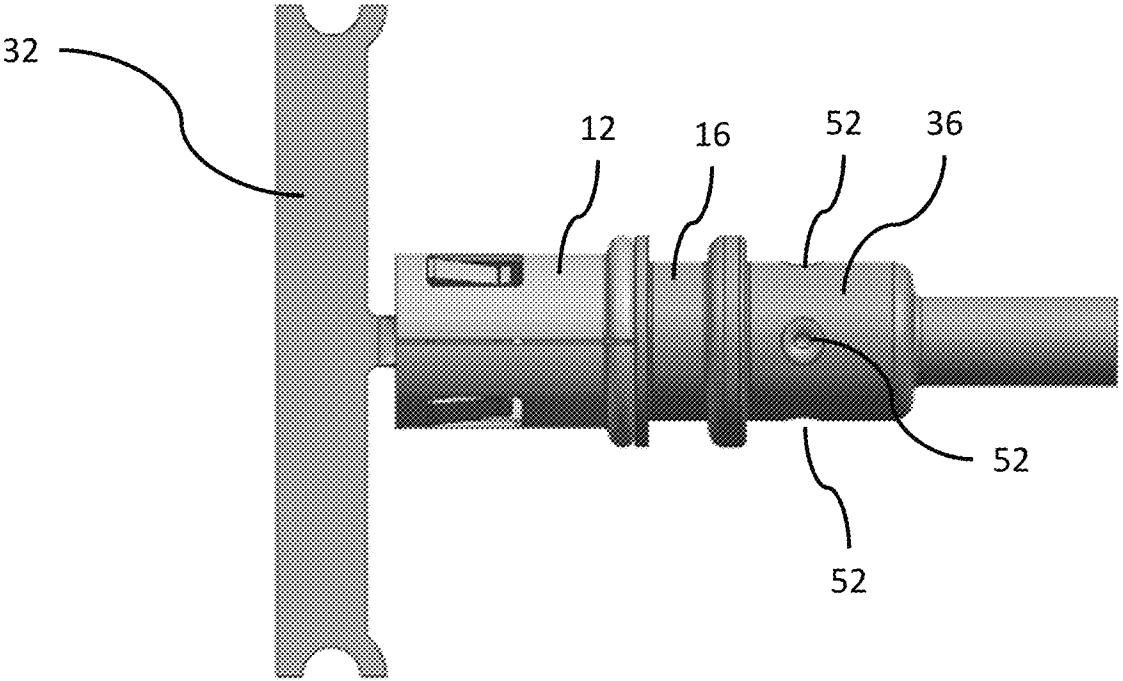
FIG. 7 is a top view of the outer contact of the assembly of FIG. 6 with dimples formed in the outer contact and inner ferrule according to one embodiment.
Figure 13:
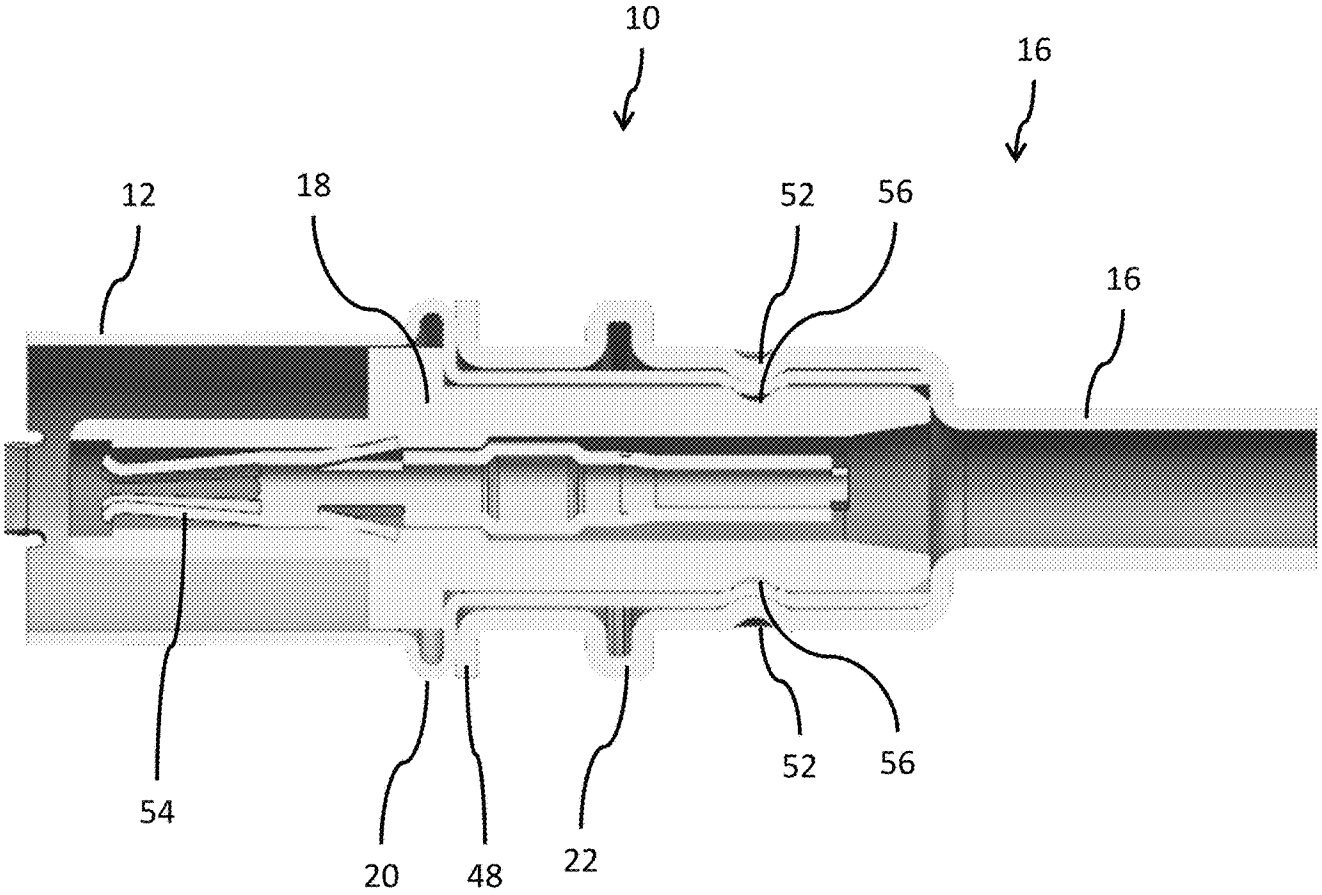
FIG. 13 is a cross section view of the assembly of FIG. 11 according to one embodiment.

STEP 124, FORM A DIMPLE IN BOTH THE INNER FERRULE AND THE OUTER CONTACT, includes forming a dimple 52 in both the first ferrule portion 36 and the outer contact 12, thereby securing the inner ferrule 16 to the outer contact 12 as illustrated in FIG. 7. The dimple 52 may be formed by a placing a resilient material within the outer connect and punching the inner ferrule 16 with a round ended punch tool The example illustrated in FIG. 7 includes four dimples 52 circumferentially formed and spaced every 90°. As illustrated in FIG. 13, the dimples 52 are formed in both the inner ferrule 16 and the outer contact 12. STEP 124 may be performed in the order listed following STEP 122 or may alternatively be performed following STEP 130.

STEP 126, PROVIDE AN INSULATOR AND AN INNER CONTACT, includes providing an insulator 18 formed of a dielectric material and an inner contact 54 configured to terminate the center conductor 40 of the coaxial cable 42. The insulator 18 electrically isolates the inner contact 54 from the outer contact 12. The inner contact 54 is connected to the center conductor 40 of the coaxial cable 42 as shown in FIG. 9.

Figure 8:
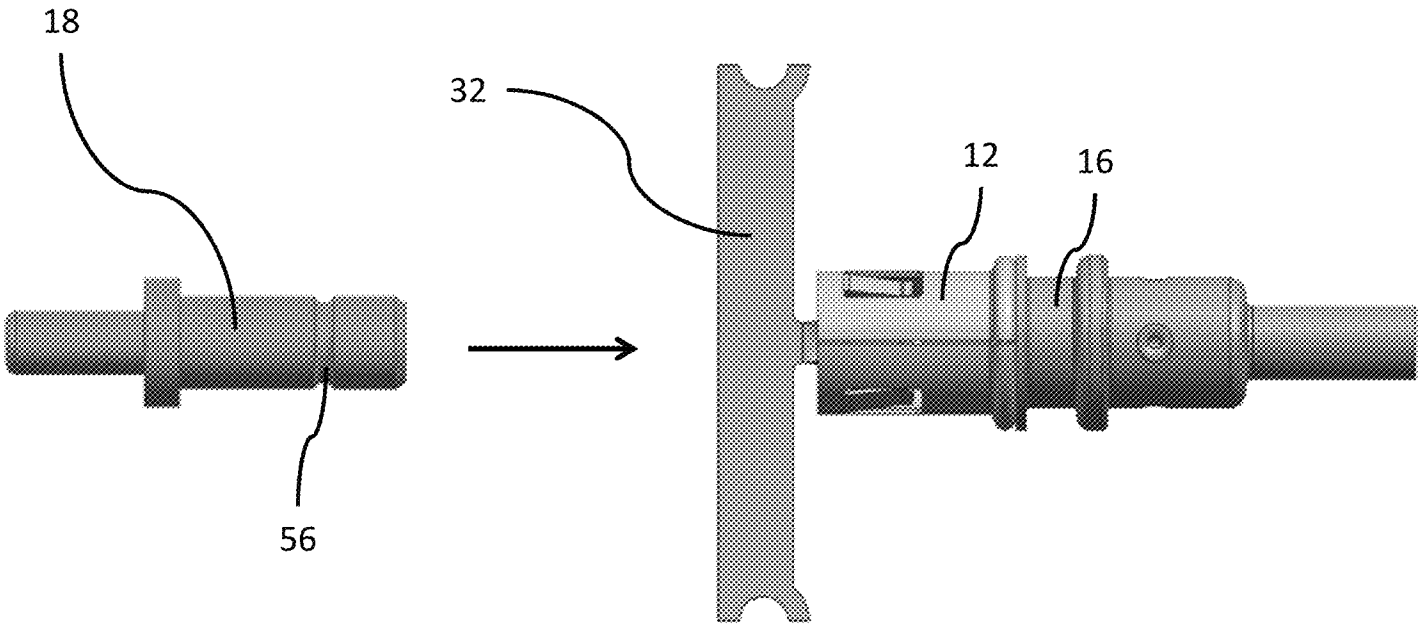
FIG. 8 is a top view of a process of inserting an insulator into the assembly of FIG. 7 according to one embodiment.

STEP 128, INSERT THE INSULATOR WITHIN THE OUTER CONTACT, includes inserting the insulator 18 within the outer contact 12 as shown in FIG. 8. The insulator 18 defines a circumferential groove 56 that is configured to engage the dimples 52 as illustrated in FIG. 13, thereby creating an interference fit and securing the insulator 18 within the outer contact 12.

Figure 9:
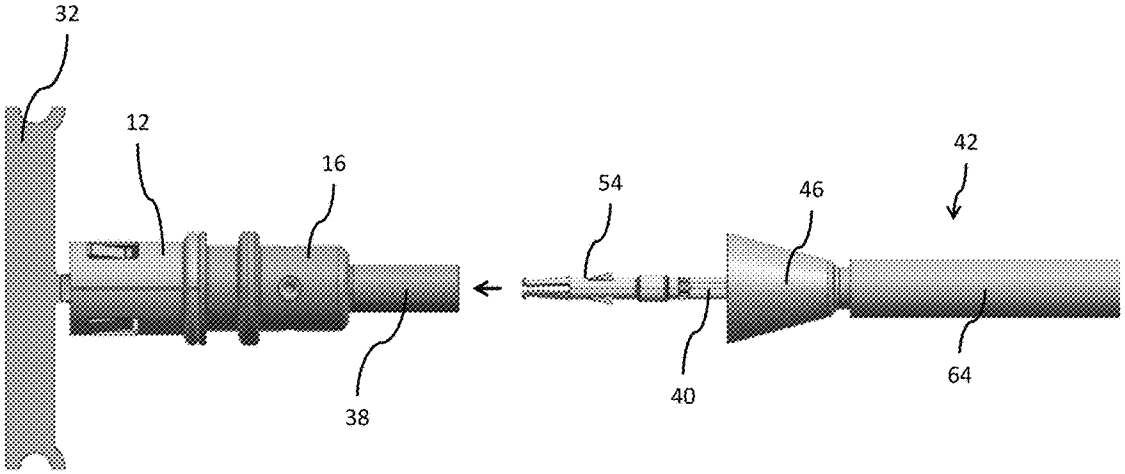
FIG. 9 is a top view of a process of inserting a inner contact into the assembly of FIG. 8 according to one embodiment.
Figure 10:
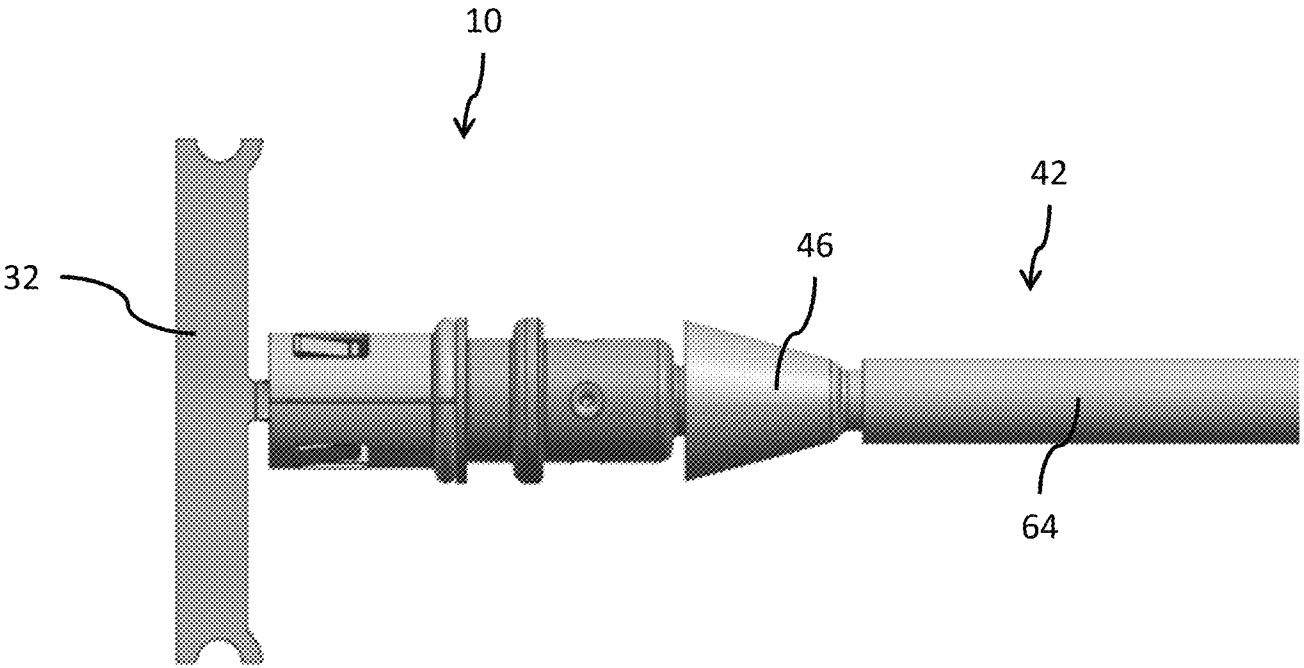
FIG. 10 is a top view of a process of flaring a shield braid around a portion according to one embodiment.

STEP 130, INSERT THE INNER CONTACT WITHIN THE INSULATOR, includes inserting the inner contact 54 within the insulator 18 that is disposed within the outer contact 12 as illustrated in FIG. 9. The shield braid 46 of the coaxial cable 42 may be flared prior to STEP 130 so that it will overlie the second ferrule portion 38 as shown in FIG. 10. The order in which STEPS 128 and 130 are performed may change based on the relationship of diameter D1 to D2. If diameter $D_2$ is larger than diameter $D_1$, STEPS 128 and 130 may be performed in the order listed. If diameter $D_2$ is smaller than diameter $D_1$, the order in which STEPS 128 and 130 are performed may be reversed.

Figure 12:
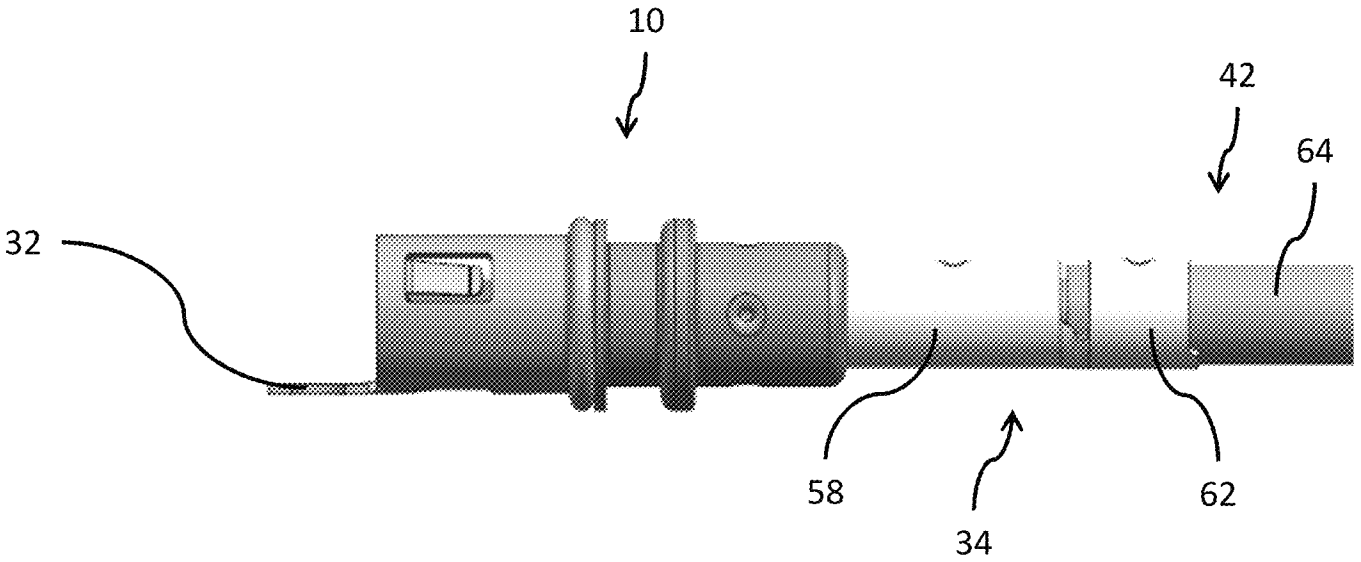
FIG. 12 is a side view of the assembly of FIG. 11 according to one embodiment.

STEP 132, POSITION THE OUTER FERRULE TO THE SECOND PORTION OF THE INNER FERRULE, includes positioning the outer ferrule 34 to the second ferrule portion 38 as shown in FIG. 11 such that the shield braid 46 of the coaxial cable 42 is sandwiched between the second ferrule portion 38 and the outer ferrule 34 as shown in FIG. 12.

STEP 134, CRIMP THE OUTER FERRULE ABOUT THE SHIELD BRAID, is an optional step that may be performed when the outer ferrule 34 has a pair of crimping wings 58 having a first ferrule end 60A and a second ferrule end 60B as shown in FIG. 11. STEP 134 includes crimping the outer ferrule 34 about the shield braid 46 such that the first ferrule end 60A opposes the second ferrule end 60B.

STEP 136, CRIMP INSULATION CRIMPING WINGS TO AN INSULATION JACKET OF THE COAXIAL CABLE, is an optional step that may be performed when the outer ferrule 34 has a pair of insulation crimping wings 62 as shown in FIG. 11. STEP 136 includes crimping the insulation crimping wings 62 to an insulation jacket 64 of the coaxial cable 42 as shown in FIG. 12, thereby providing strain relief for the coaxial connector 10/coaxial cable interface. Following STEP 136, the carrier strip 32 may be separated from the coaxial connector assembly 10.

While the coaxial connector 10 in the illustrated example is a straight or 180° configuration between the coaxial cable 42 and the outer and inner contacts 12, 54, other embodiments may be envisioned in which the coaxial connector is in a right angle or 90° configuration or any other angular confirmation.

Accordingly, coaxial connector assembly 10 and a method 100 of forming such a coaxial connector assembly 10 is provided. Forming the outer contact 12, inner ferrule 16, and outer ferrule 34 though stamping or extruding processes provides lower manufacturing cost compared to equivalent components formed by machining or casting process. The seamless inner ferrule 16 is more robust than a stamped ferrule having a seam and provides mechanical and electrical performance similar to a machined ferrule. The first and second ribs 20, 22 provide features to lock the coaxial connector 10 within a FAKRA-type housing without the need for additional molded components as seen in the prior art. Forces applied to the locking features translate to the robust seamless tube, not the seamed portion, i.e. outer contact 12, of the coaxial connector 10. The drawing and extruding processes used to form the inner ferrule 16 provide tighter tolerances than seamed ferrules. The inner ferrule 16 has an abrupt transition between the first and second diameters, allowing the overall length of the coaxial connector 10 to be decreased.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A coaxial connector assembly, comprising:

an inner contact configured to terminate a center conductor of a coaxial cable;

an insulator formed of a dielectric material holding the inner contact;

an outer contact surrounding the insulator and the inner contact configured to terminate a shield braid of the coaxial cable, wherein the outer contact is formed from a first flat work piece having a first contact end and a second contact end and wherein the outer contact is formed into a barrel shape such that the first contact end opposes the second contact end at a seam extending along an entire length of the outer contact;

an outer ferrule formed from a second flat work piece; and a seamless inner ferrule formed from a third flat work piece, said inner ferrule having a first ferrule portion with a first diameter and having a second ferrule portion with a second diameter that is different from the first diameter, wherein the first ferrule portion surrounds at least a portion of the outer contact and wherein the shield braid is sandwiched between the second ferrule portion and the outer ferrule.

2. The coaxial connector assembly according to claim 1, wherein the third flat work piece is formed of sheet metal and wherein the inner ferrule is seamlessly formed using a deep draw stamping process.

3. The coaxial connector assembly according to claim 1, wherein the second flat work piece is formed of sheet metal and wherein the outer ferrule is seamlessly formed using a deep draw stamping process.

4. The coaxial connector assembly according to claim 1, wherein the second flat work piece forming the outer ferrule has a first ferrule end and a second ferrule end and wherein the outer ferrule is crimped about the shield braid such that the first ferrule end opposes the second ferrule end.

5. The coaxial connector assembly according to claim 4, wherein the outer ferrule defines a pair of insulation crimping wings crimped to an insulation jacket of the coaxial cable.

6. The coaxial connector assembly according to claim 1, wherein the at least a portion of the outer contact is received within the first ferrule portion and wherein a dimple is formed in both the first ferrule portion and the outer contact, thereby securing the inner ferrule to the outer contact.

7. The coaxial connector assembly according to claim 6, wherein the insulator defines a circumferential groove and wherein at least a portion of the dimple formed in the outer contact is disposed within the circumferential groove, thereby securing the insulator within the outer contact.

8. The coaxial connector assembly according to claim 1, wherein the outer contact defines a first circumferential rib and wherein the first ferrule portion defines a second circumferential rib.

9. The coaxial connector assembly according to claim 8, wherein the inner ferrule defines a circumferential flange configured to abut the first circumferential rib.

10. The coaxial connector assembly according to claim 1, wherein the outer contact is attached to a carrier strip.

11. A method of forming a coaxial connector assembly, comprising the steps of:

forming a first flat work piece having a first contact end and a second contact end into an outer contact having a barrel shape such that the first contact end opposes the second contact end at a seam extending along an entire length of the outer contact;

forming an outer ferrule from a second flat work piece;

seamlessly forming an inner ferrule from a third flat work piece, said inner ferrule having a first ferrule portion with a first diameter and having a second ferrule portion with a second diameter that is different from the first diameter;

inserting at least a portion of the outer contact within the first ferrule portion;

providing an insulator formed of a dielectric material and an inner contact configured to terminate a center conductor of a cable;

inserting the insulator within the outer contact;

inserting the inner contact within the insulator; and positioning the outer ferrule to the second ferrule portion such that a shield braid of the coaxial cable is sandwiched between the second ferrule portion and the outer ferrule.

12. The method according to claim 11, wherein the third flat work piece is formed of sheet metal and wherein the inner ferrule is seamlessly formed using a deep draw stamping process.

13. The method according to claim 11, wherein the second flat work piece is formed of sheet metal and wherein the outer ferrule is seamlessly formed using a deep draw stamping process.

14. The method according to claim 11, wherein the outer ferrule has a first crimping wing having a first ferrule end and has a second crimping wing having a second ferrule end and wherein the method further comprises the step of crimping the outer ferrule about the shield braid such that the first ferrule end opposes the second ferrule end.

15. The method according to claim 14, wherein the outer ferrule has a pair of insulation crimping wings and wherein the method further comprises the step of crimping the insulation crimping wings to an insulation jacket of the coaxial cable.

16. The method according to claim 11, further comprising the step of forming a dimple in both the first ferrule portion and the outer contact, thereby securing the inner ferrule to the outer contact.

17. The method according to claim 16, wherein the insulator defines a circumferential groove and wherein at least a portion of the dimple formed in the outer contact is disposed within the circumferential groove, thereby securing the insulator within the outer contact.

18. The method according to claim 11, further comprising the steps of:

forming a first circumferential rib on the outer contact; and forming a second circumferential rib on the first ferrule portion.

19. The method according to claim 18, further comprising the steps of forming a circumferential flange on the inner ferrule configured to abut the first circumferential rib.

20. The method according to claim 11, wherein the outer contact is attached to a carrier strip.

* * * * *